United States Patent [19]

Josemans

[11] 4,174,472

[45] Nov. 13, 1979

[54] PIVOTED-ACTUATOR SWITCH WITH INTEGRAL OFF-LOCK

[75] Inventor: Leonardus J. Josemans, Smithfield, N.C.

[73] Assignee: Cutler-Hammer, Inc., Milwaukee, Wis.

[21] Appl. No.: 955,109

[22] Filed: Oct. 26, 1978

[51] Int. Cl.[2] ..... H01H 93/20; H01H 21/80; H01H 9/22

[52] U.S. Cl. ..... 200/68; 200/42 T; 200/322; 200/325

[58] Field of Search ..... 200/321, 322, 325, 327, 200/42 T, 68

[56] References Cited

U.S. PATENT DOCUMENTS

| | | | |
|---|---|---|---|
| 3,598,162 | 8/1971 | Rosenthal | 200/44 |
| 3,626,118 | 12/1971 | Botefuht | 200/42 R |
| 3,906,176 | 9/1975 | Carlson | 200/42 T |
| 4,013,858 | 3/1977 | Grebner et al. | 200/321 |
| 4,121,065 | 10/1978 | Woodard | 200/42 T |

FOREIGN PATENT DOCUMENTS

| | | | |
|---|---|---|---|
| 1947014 | 3/1971 | Fed. Rep. of Germany | 200/321 |

*Primary Examiner*—Steven L. Stephan
*Attorney, Agent, or Firm*—Hugh R. Rather; William A. Autio

[57] ABSTRACT

A pivoted-actuator switch having a switch operator including a pivotally-mounted contact actuator and a manually-grasped, removable operating lever or "key" snap-in mounted to the contact actuator for actuating the switch. A spring-biased pivotal lock bar is normally retracted by the operating lever into the contact actuator so as to clear the rim of the hole in the switch housing through which the contact actuator extends. When the operating lever is removed, the spring pivots the lock bar to extend out from the contactor actuator and to catch on the rim of the hole thereby to prevent operation of the switch from off to on position. When the switch is on, it can nevertheless be turned off because this lock bar is shaped for one-way cam-in past the rim and then to pivot out again to abut the top of the rim. The operating lever has a projecting finger effective when inserted into the contact actuator to pivot the lock bar inwardly to clear the housing rim and thus to allow normal switch operation. The housing may be shaped to make the lock bar inaccessible for unlocking from the outside.

8 Claims, 5 Drawing Figures

PIVOTED-ACTUATOR SWITCH WITH INTEGRAL OFF-LOCK

BACKGROUND OF THE INVENTION

Non-integral and integral off-locks for electric switches have been known heretofore. In one form of the non-integral type, a trigger type switch actuator, a spring-biased dog and a removal release key are separately mounted in the tool handle. This spring-biased dog moves into the path of the trigger to prevent operation thereof, and the key must be depressed to pivot this dog out of the path of trigger travel to allow operation of the switch. This key can be removed to lock the switch off. This non-integral type of off-lock has the disadvantage that it is not self-contained and thus requires that individual parts must be mounted in the tool handle or housing in which the switch is used.

In one form of the integral type, a pivotally-mounted contact actuator is provided with an elongated, spring-biased, longitudinally slidable lock lever that extends out to catch below the rim of the hole in the switch frame. This lock lever has a pair of wings with angular surfaces that are cammed by respective projections on a snap-in operating member to retract the lock lever clear of the hole rim to allow normal operation of the switch. This integral type, while wholly satisfactory in use, nevertheless requires rather complex molded parts and the lock lever requires a rather large amount of space within the pivotally-mounted contact actuator that also must accommodate spring-biased plungers that slide along the movable contacts.

Accordingly, it has been found desirable to provide a pivoted-actuator switch with an integral off-lock that overcomes disadvantages of the aforementioned type.

SUMMARY OF THE INVENTION

This invention relates to pivoted-actuator switches and more particularly to switches of that type having an integral or built-in releasable off-lock.

An object of the invention is to provide an improved pivoted-actuator switch.

A more specific object of the invention is to provide an improved safety switch of the pivoted-actuator type.

Another specific object of the invention is to provide a pivoted-actuator switch with an improved off-lock that is simple in construction and efficient and reliable in operation.

Another specific object of the invention is to provide an improved pivoted-actuator switch with an integral off-lock having a minimum number of parts that are easily assembled.

Other objects and advantages of the invention will hereinafter appear.

DESCRIPTION OF THE PREFERRED EMBODIMENT

Figure 1:
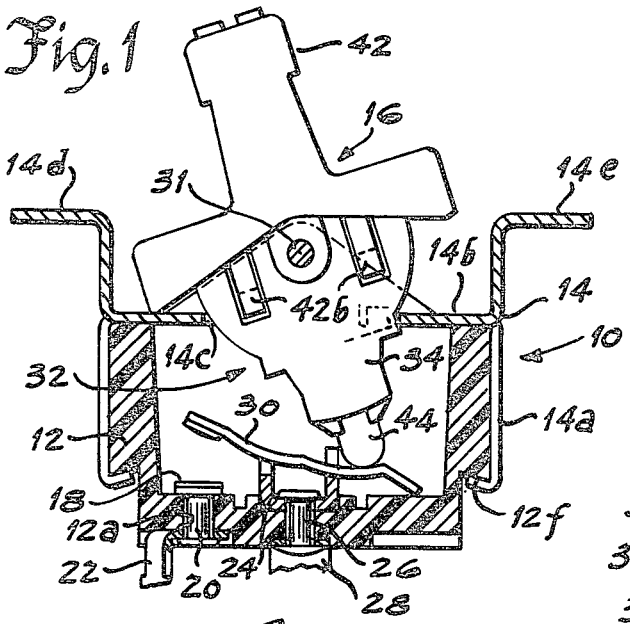
FIG. 1 is an enlarged cross-sectional view of a double-pole single-throw pivoted-actuator switch with integral off-lock showing the snap-in structure of the manually-grasped, removable operating lever.

Referring to FIG. 1, there is shown a pivoted-actuator safety switch constructed in accordance with the invention, the term "safety" meaning that it will latch automatically in the off position if the manual operating lever part of the switch operator is removed from the contact actuator. As shown therein, the safety switch is provided a switch housing 10 comprising an insulating base 12 and a metal frame 14. While a metal frame is shown, it will be apparent that a molded insulated frame provided, along with the base, with suitable snap-in coupling structure could as well be used.

This base 12 is a generally rectangular cup closed at the top by the frame which pivotally supports a switch operator 16 hereinafter described and is provided with means for supporting stationary and movable contacts. For this purpose, the flat bottom of the base is provided with a plurality of round holes 12*a*, for example, four holes for the double-pole single-throw switch illustrated, through which rivets extend to connect internal stationary contacts to external terminals. As shown in FIG. 1, there is a left end contact 18 connected by a rivet 20 to an external terminal 22. And there is a central stationary contact 24 connected by a rivet 26 to an external terminal 28. Left end stationary contact 18 is in the form of a flat coined element similar to rivet head whereas central stationary contact 24 is in the form of a cradle for rockably supporting a two-position movable bridging contact 30 in a known manner. A similar set of contacts is provided for the other pole of the switch.

Figure 4:
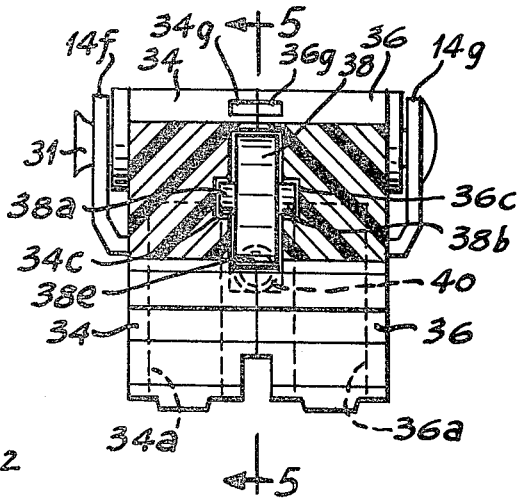
FIG. 4 is a lateral cross-sectional view taken along line 4—4 of FIG. 3 to show the structure pivotally supporting the off-lock bar in the contact actuator.

Frame 14 is provided with means for attaching it to base 12, for supporting a switch operator and for mounting the switch to a mounting panel. For these purposes, the frame is provided with a plurality of depending legs 14*a* that embrace the ends of the base and their lower ends are bent inwardly into undercut notches 12*b* to secure the frame to the base as shown in FIG. 1. Frame 14 has a flat surface 14*b* overlying the base with a generally rectangular hole 14*c* centrally therein through which switch operator subassembly 16 extends into the base for actuation of the contacts. Frame 14 additionally has left and right upwardly and outwardly turned arms 14*d* and 14*e*, respectively, as shown in FIG. 1, each having a threaded hole or other suitable means for mounting the switch in a hole in a mounting panel. Furthermore, frame 14 has switch operator supporting means including a pair of spaced, upstanding generally low triangular, bent-up portions 14*f* and 14*g* having aligned holes therethrough for a pivot pin 31 that supports the switch operator subassembly as shown in FIGS. 1 and 4. While a metal frame has been shown, it will be apparent that a molded plastic insulating frame or bezel such as shown in my copending application Ser. No. 883,957, filed Mar. 6, 1978, with or without guard plates and the non-removability slots therein could be used herein.

Figure 2:
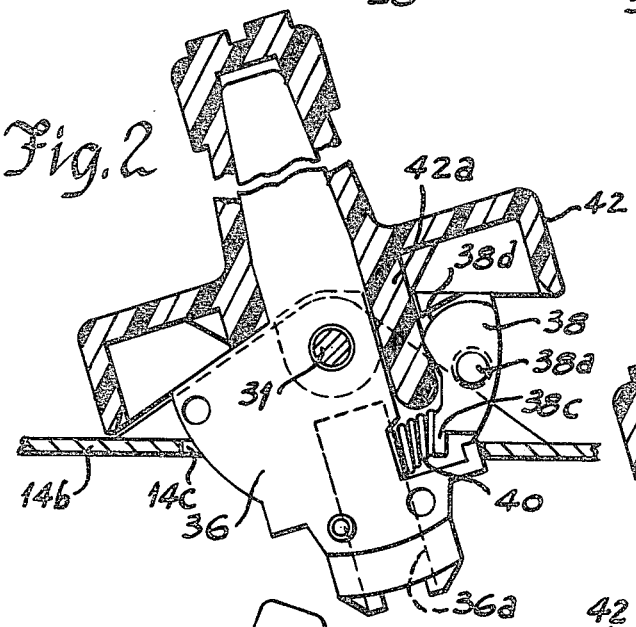
FIG. 2 is a further enlarged cross-sectional view of the pivotally-mounted switch operator and a portion of the housing showing the off-lock in its normal retracted position.
Figure 3:
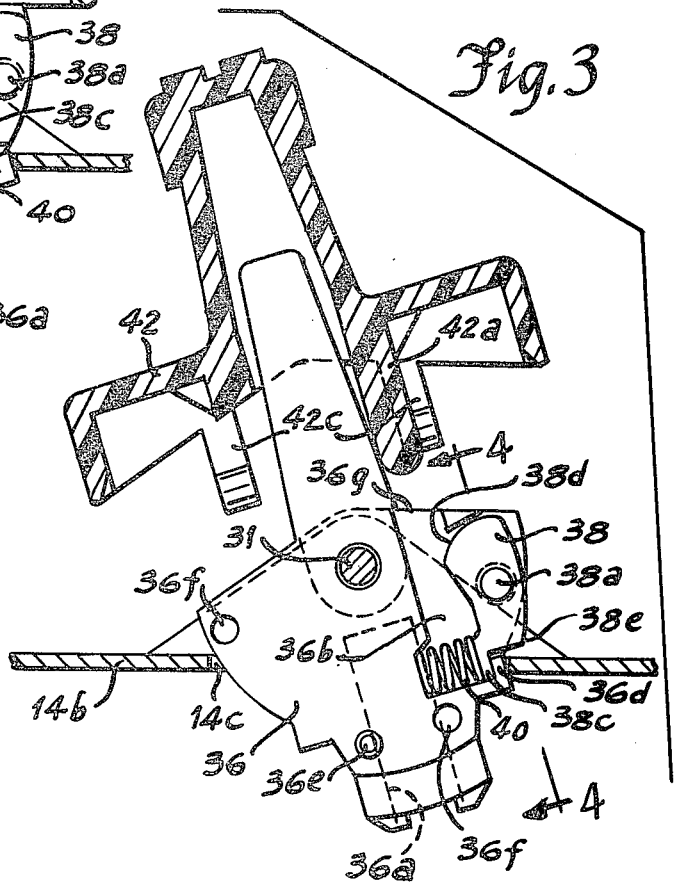
FIG. 3 is a cross-sectional view like FIG. 2 but showing the operating lever separated from the contact actuator and the pivoted off-lock bar being in its extended locking position within one of the two halves of the contact actuator.

Switch operator subassembly 16 comprises five parts exclusive of the pivot pin. These parts include a contact actuator 32 shown in FIG. 1 having two complementary contact actuator halves 34 and 36 of molded insulating material as shown in FIG. 4. This switch operator subassembly also comprises a lock member or bar 38 confined between and pivotally supported within the right-hand sides of the contact actuator halves for limited movement between the retracted position shown in FIG. 2 and the extended position shown in FIG. 3. A helical compression spring 40 is trapped between the lower end of lock bar 38 and a wall of the lock bar receiving cavity 34*a*, 36*a* as shown in FIGS. 2–4. This switch operator subassembly further comprises an operating lever 42 that is inserted into and snap-in coupled to the contact actuator and serves both as the handle or button whereby the switch is manually operated and also as the "key" that normally releases the off-lock or latch and upon removal allows the contact actuator automatically to lock in its off position.

These contact actuator halves 34 and 36 are provided with means for operating the respective movable contacts such as contact 30. For this purpose, each contact actuator half is provided with a bore 34*a*, 36*a* shown in FIG. 4 extending up from its lower, reduced end portion for retaining a spring-biased plunger 44 shown in FIG. 1 which plunger slides along and rockably actuates the respective movable contact 30 when the switch operator is pivotally actuated. Suitable helical compression springs bias these plungers 44 downwardly onto the movable contacts in known manner.

Figure 5:
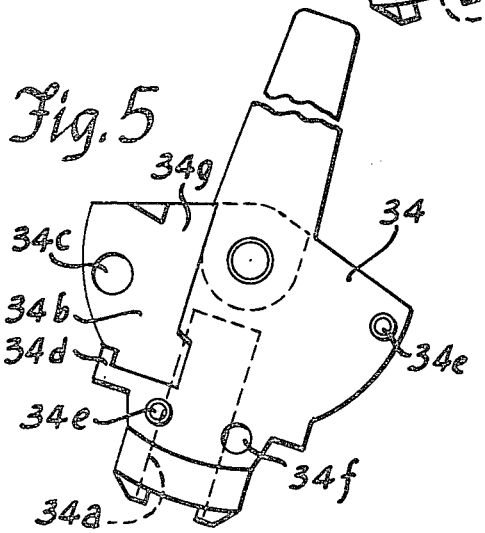
FIG. 5 is an interior view of the other one of the two halves of the contact actuator substantially along line 5—5 of FIG. 4.

These contact actuator halves 34 and 36 are also provided therebetween with a slot for the lock bar formed by symmetrical recesses 34*b*, 36*b* in their abutting surfaces as shown in FIGS. 3–5. These recesses are integrally molded in the two contact actuator halves and each such recess is provided with a deeper cylindrical hole 34*c*, 36*c*, these holes being in alignment when the two halves are juxtaposed facing one anther and serve to journal trunnions 38*a* and 38*b* of the pivotal lock bar as shown in FIG. 4. Each recess 34*b*, 36*b* is provided at its lower portion with a lip 34*d*, 36*d* shown in FIGS. 3 and 5 which together form a stop for the lower tip 38*c* of lock bar 38 to limit its extension from the contact actuator under the force of spring 40 when the operating lever is removed as shown in FIG. 3. The upper inwardly-facing portion of the lock bar is provided with a curved cam surface 38*d* that is slidingly engaged by projection 42*a* of the operating lever when the latter is inserted in place to release the lock, this cam surface 38*d* being above trunnions 38*a*, 38*b* to cause pivoting of the lock bar. The outwardly-facing surface of the lock bar below the trunnions thereof is provided with a unidirectional stop lug 38*e* below the pivot. As shown in FIG. 3, this stop lug has a sharp-angled lower side that will abut the upper edge of the rim of hole 14*c* in the frame to lock the switch operator in its off position. On the other hand, the upper side of this stop lug has a gradually-sloping cam surface that will bear against the rim of the hole but will allow the contact actuator to be pivoted from on to off position after the operating lever has been removed. For this purpose, this gradually-sloping cam surface 38*e* will slide on the rim of the hole which will push the lock bar in enough to allow the contact actuator to be pivoted from on to off position.

These two contact actuator halves are kept in registration with one another by a plurality of suitable projections 34*e* and 36*e* fitting snugly into complementary recesses 34*f* and 36*f* in the opposite half as shown in FIGS. 2, 3 and 5. With such relatively-unshiftable interfitting engagement, the two contact actuator halves are then held securely between upstanding pivotally-supporting portions 14*f* and 14*g* of the frame with headed pivot pin 31 passing therethrough and flared at its other end to support the contact actuator for pivotal movement.

Operating lever 42 serves not only as the manually engagable part for actuating the switch but also as the removable "key" that leaves the switch locked or latched in its off position. For this purpose, this operating lever is provided with the aforementioned projection 42*a* having a rounded end for engaging cam surface 38*d* which is above the lock bar pivot to rotate the lock bar on its trunnions and thereby withdraw stop lug portion 38*e* into the contact actuator when this operating lever is inserted and snapped into place. For entry of projection 42*a*, the contact actuator is provided with a hole or continuation of the slot extending down from the top into the lock bar slot therein, this hole being formed by channels 34*g* and 36*g* opposite one another in the two halves of the contact actuator.

This operating lever and the contact actuator are provided with snap-in means coupling the same to one another while allowing removal of the operating lever by grasping it with the fingers and pulling it up and away from the contact actuator when it is desired to prevent unauthorized use of the tool on which this switch is used. This means comprises two pairs of inwardly detented resilient legs 42*b* and 42*c* shown most clearly in FIGS. 1 and 3. The two legs of the first pair 42*b* thereof are symmetrically spaced on the front of the operating lever and the two legs of the other pair thereof are symmetrically spaced on the back of the operating lever. The front and rear walls of the contact actuator are provided with complementary vertical grooves leading down from the upper corners thereof and having deeper portions at their lower ends for the detents on leg pairs 42*b* and 42*c* thereby to afford snap-in retention of the operating lever on the contact actuator as well as snap-out removal when desired.

This operating lever is further provided with a suitable external configuration to facilitate grasping by the hand of the user. This configuration may be any of the known forms of toggle lever, bat handle, rocker button, paddle or the like, or a combination thereof, having sufficient gripping surface not only for operating the switch but also for pulling the operating lever away to lock the switch off.

While a contact actuator formed from two complementary halves has been shown as the preferred form it will be apparent that a single-piece molded contact actuator alternatively could be used. In such case, the lock lever could be pivoted by providing a hole therethrough and through the contact actuator and inserting a pivot pin thereinto in place of the trunnions shown.

To operate the switch from its off or contact open state shown in FIG. 1 to its on or contact closed state, the operating lever is grasped and rotated clockwise. As a result, plunger 44 slides toward the left along the movable contact to a point where the movable contact rocks down to engage stationary contact 18. In this condition, the movable contact bridges the two stationary contacts to complete the circuit between terminals 22 and 28. If operating lever 42 is now removed, the contact actuator may nevertheless be pivoted back counterclockwise to off position. To do this, the gradual slope of stop lug 38*e* slides on the rim of the hole in the frame until reaching the position shown in FIG. 3 whereupon spring 40 pivots lock bar 38 counterclockwise so that stop lug 38*e* extends out above the rim of the hole in the frame to lock the switch off. The usual operation, however, is to turn the switch off by its operating lever and then remove the operating lever to prevent unauthorized operation or for safety reasons.

While the apparatus hereinbefore described is effectively adapted to fulfill the objects stated, it is to be understood that the invention is not intended to be confined to the particular preferred embodiment of pivoted-actuator switch with integral off-lock disclosed, inasmuch as it is susceptible of various modifications without departing from the scope of the appended claims.

I claim:

1. A self-enclosed pivoted-actuator switch with integral off-lock comprising:

a switch housing;

stationary contact means within said housing connected to external terminals;

movable contact means within said housing selectively operable to an "on" position closing a circuit with respect to said stationary contact means or to an "off" position opening said circuit;

a switch operator subassembly;

a hole in said housing;

supporting means on said housing adjacent said hole pivotally mounting said switch operator subassembly for reciprocal movement to actuate said movable contact means;

and said switch operator subassembly comprising:

a contact actuator extending from said pivotal supporting means through said hole into said housing for actuating said movable contact means to said "on" or "off" position;

a slot within said contact actuator;

a spring-biased locking member pivotally mounted within said slot in said contact actuator and having a normal unlocking position wherein said member is retracted into said contact actuator and a locking position wherein a stop lug of said locking member at one side of its pivot projects from said contact actuator to abut the top of the rim of said hole in order to lock said contact actuator in its "off" position;

a removable operating lever having a manually engagable portion;

means for snap-in coupling said operating lever to said contact actuator so that selective actuation thereof by said manually engagable portion effects pivotal movement of both said removable operating member and said contact actuator coupled thereto;

a cam on said locking member at the other side of its pivot;

and a projection on said removable operating lever operable when inserted into said slot to engage said cam and pivot said locking member to retract said stop lug into said unlocking position thereby to allow normal operation of the switch.

2. The self-enclosed pivoted-actuator switch with integral off-lock claimed in claim 1, wherein:

said stop lug is at the outer side of said locking member below its pivot and said cam is at the inner side of said locking member above its pivot so that pivoting of said locking member by engagement of said cam causes withdrawal of said stop lug within said contact actuator.

3. The self-enclosed pivoted-actuator switch with integral off-lock claimed in claim 1, wherein:

said contact actuator comprises two complementary molded insulating halves held together by said supporting-means;

and said slot comprises recesses in the facing surfaces of said halves adjoining one another.

4. The self-enclosed pivoted-actuator switch with integral off-lock claimed in claim 1, wherein:

said spring-biased locking member comprises an helical compression spring between a wall of said slot and the side of said locking member substantially opposite said stop lug.

5. The self-enclosed pivoted-actuator switch with integral off-lock claimed in claim 1, wherein:

said contact actuator has a curved surface of substantially constant radius at said stop lug that normally moves in close proximity to said rim of said hole in said housing as said switch operator subassembly is actuated between "on" and "off" positions.

6. The self-enclosed pivoted-actuator switch with integral off-lock claimed in claim 1, wherein:

said housing comprises an upstanding portion at the side where said stop lug projects out from said contact actuator to prevent access for depressing said stop lug when said operating lever has been removed.

7. The self-enclosed pivoted-actuator switch with integral off-lock claimed in claim 1, wherein:

said contact-actuator comprises an integrally-molded lip adjacent said slot that limits the outward projection of said stop lug to the required amount.

8. The self-enclosed pivoted-actuator switch with integral off-lock claimed in claim 1, wherein:

said slot in said contact actuator is to one side of said pivotal supporting means thereby to leave sufficient space in said contactor actuator for contact actuating plungers.

* * * * *